US005217534A

United States Patent [19]

Hernandez et al.

[11] Patent Number: 5,217,534

[45] Date of Patent: Jun. 8, 1993

[54] WALLPAPER TROUGH APPARATUS

[76] Inventors: Anthony R. Hernandez; Yolanda M. Hernandez, both of 2605 Potomac Ave., Bakersfield, Calif. 93307

[21] Appl. No.: 779,054

[22] Filed: Oct. 18, 1991

[51] Int. Cl.[5] ..... B05C 1/06

[52] U.S. Cl. ..... 118/235; 118/249; 118/258; 118/259; 118/266; 118/419; 118/428; 118/429; 118/DIG. 17

[58] Field of Search ..... 118/DIG. 17, 419, 429, 118/235, 249, 258, 259, 266, 423, 428

[56] References Cited

U.S. PATENT DOCUMENTS

| | | | |
|---|---|---|---|
| 471,958 | 3/1892 | Danforth | 118/DIG. 17 |
| 1,337,729 | 4/1920 | Selby | 118/249 |
| 2,443,971 | 6/1948 | Winzer | 118/419 |
| 5,050,529 | 9/1991 | Pardee | 118/419 |

*Primary Examiner*—W. Gary Jones
*Assistant Examiner*—Steven P. Griffin
*Attorney, Agent, or Firm*—Leon Gilden

[57] ABSTRACT

A trough structure is arranged for directing and supporting a roll of wallpaper webbing therethrough to effect wetting or adherence of glue to the wallpaper structure. The trough structure includes a forward wall spaced from a partition wall, with the partition wall spaced forwardly of a rear edge portion of the side walls to define a roll support cavity to rotatably mount the wallpaper roll therewithin. A modification of the invention includes an applicator brush in association with a trough guide roll to apply a glue material to a bottom surface of the wallpaper webbing, and may further include a supply reservoir arranged for pressurizing and directing fluid glue interiorly of the trough structure through the associated applicator roll.

3 Claims, 5 Drawing Sheets

WALLPAPER TROUGH APPARATUS

BACKGROUND OF THE INVENTION

1. Field of the Invention

The field of invention relates to wallpaper apparatus, and more particularly pertains to a new and improved wallpaper trough apparatus wherein the same is arranged for imparting moisture in the form of water or glue onto wallpaper to permit its mounting to an associated wall structure.

2. Description of the Prior Art

In the application of wallpaper from an associated roll of wallpaper, the procedure has in the past been expensive due to the time consuming nature relative to wallpaper mounting. To assist in the elimination of such time, prior art structure has utilized various trough arrangements to provide wetting of a wallpaper roll. The instant invention attempts to overcome deficiencies of the prior art by providing a wallpaper roll wetting structure that orients the wallpaper in a vertical orientation relative to an associated wall in a pre-moistened condition to provide for immediate mounting of the wallpaper onto the associated wall.

Prior art structure directed to wetting of a wallpaper material is exemplified in U.S. Pat. No. 4,934,311 to Topelko providing for a wallpaper trough, wherein a paper roll is immersed within a fluid reservoir and directed exteriorly of the reservoir through a guide roll.

U.S. Pat. No. 4,676,188 to McCurday provides for a wallpaper wetting trough with a rod received in a channel to force a wallpaper web into the channel underlying the rod.

U.S. Pat. No. 4,759,441 to Leurck sets forth a tool kit assembly for the application of wallpaper utilizing a brush, roll, and the like in a conventional application of wallpaper to a wall.

U.S. Pat. No. 4,244,320 to McCurday is a further example of a wallpaper trough forcing the rod within the trough structure, wherein the trough structure is formed of a memory type material to effect shape configuration of the trough and position the rod relative to the trough in use.

As such, it may be appreciated that there continues to be a need for a new and improved wallpaper trough apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of wallpaper trough apparatus now present in the prior art, the present invention provides a wallpaper trough apparatus wherein the same is arranged to direct the wallpaper through guide roll structure to effect wetting of the wallpaper webbing in use. As such, the general purpose of the present invention, which will be described subsequently in greater detail, is to provide a new and improved wallpaper trough apparatus which has all the advantages of the prior art wallpaper trough apparatus and none of the disadvantages.

To attain this, the present invention provides a trough structure arranged for directing and supporting a roll of wallpaper webbing therethrough to effect wetting or adherence of glue to the wallpaper structure. The trough structure includes a forward wall spaced from a partition wall, with the partition wall spaced forwardly of a rear edge portion of the side walls to define a roll support cavity to rotatably mount the wallpaper roll therewithin. A modification of the invention includes an applicator brush in association with a trough guide roll to apply a glue material to a bottom surface of the wallpaper webbing, and may further include a supply reservoir arranged for pressurizing and directing fluid glue interiorly of the trough structure through the associated applicator roll.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wallpaper trough apparatus which has all the advantages of the prior art wallpaper trough apparatus and none of the disadvantages.

It is another object of the present invention to provide a new and improved wallpaper trough apparatus which may be easily and efficiently manufactured and marketed.

It is a further object of the present invention to provide a new and improved wallpaper trough apparatus which is of a durable and reliable construction.

An even further object of the present invention is to provide a new and improved wallpaper trough apparatus which is susceptible of a low cost of manufacture with regard to both materials and labor, and which accordingly is then susceptible of low prices of sale to the consuming public, thereby making such wallpaper trough apparatus economically available to the buying public.

Still yet another object of the present invention is to provide a new and improved wallpaper trough apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
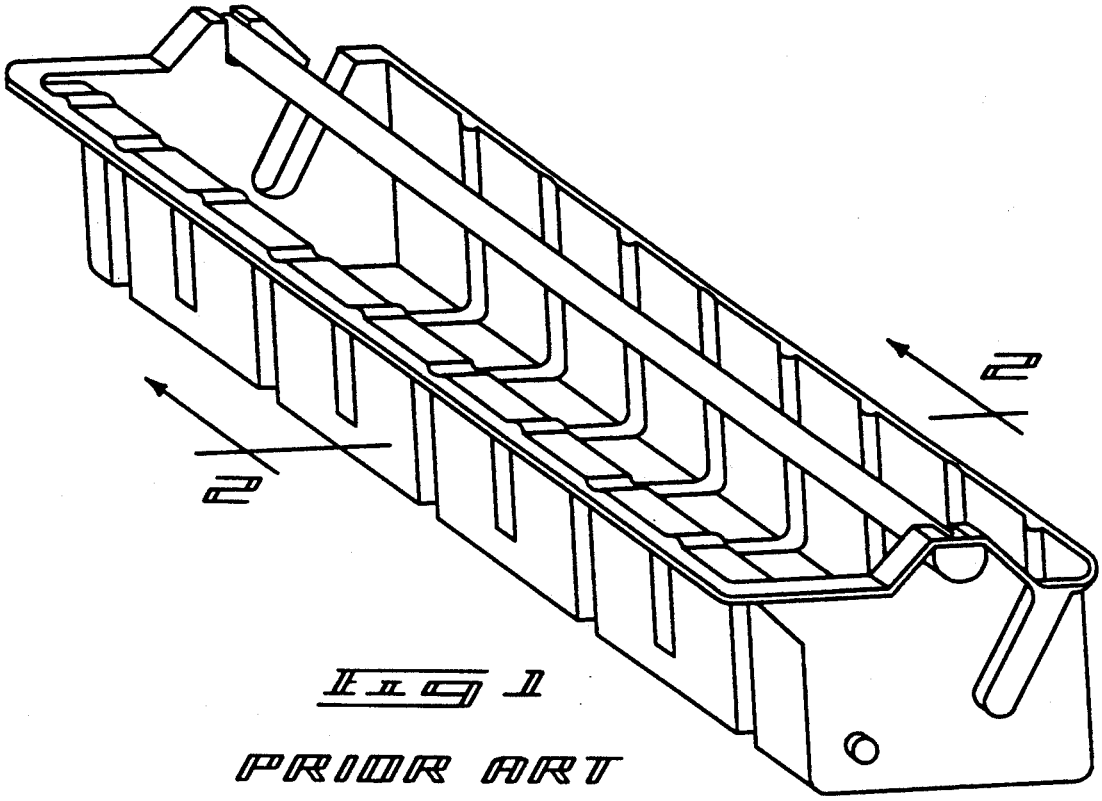
Fig 1 PRIOR ART
FIG. 1 is an isometric illustration of a prior art wallpaper trough structure.

With reference now to the drawings, and in particular to FIGS. 1 to 12 thereof, a new and improved wallpaper trough apparatus embodying the principles and concepts of the present invention and generally designated by the reference numeral 10 will be described.

Figure 2:
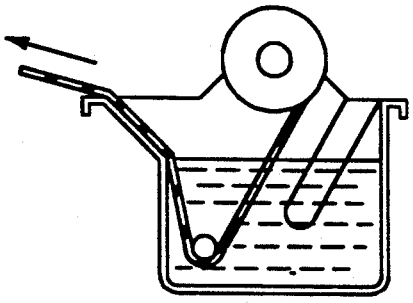
Fig 2 PRIOR ART
FIG. 2 is an orthographic side view of the wallpaper trough structure in a first configuration.
Figure 3:
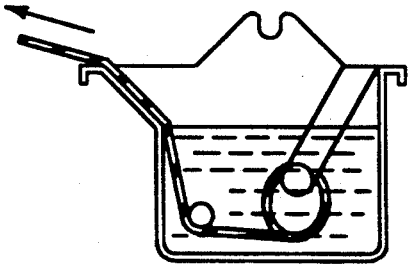
Fig 3 PRIOR ART
FIG. 3 is an orthographic side view of the wallpaper trough structure in a second configuration of the prior art, as exemplified in FIG. 1.
Figure 4:
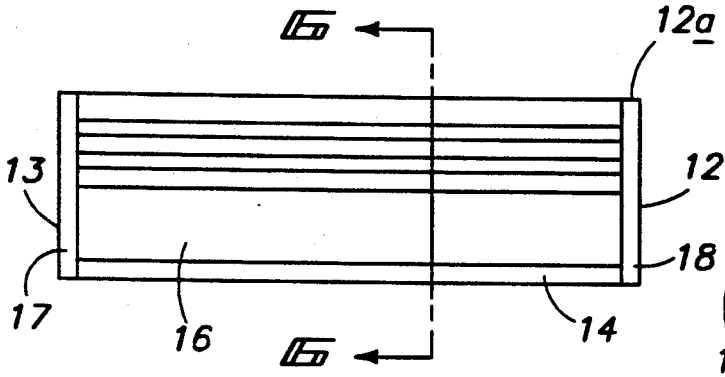
FIG. 4 is an orthographic rear view of the instant invention.
Figure 5:
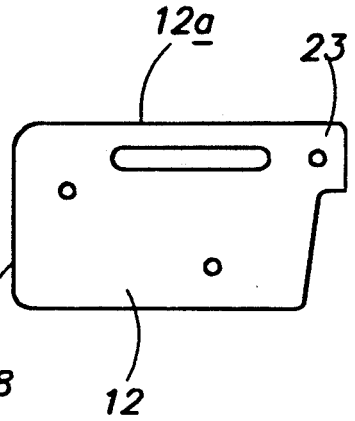
FIG. 5 is an orthographic side view of the instant invention.

The FIGS. 1-3 illustrate a prior art trough structure, as exemplified in U.S. Pat. No. 4,934,311, illustrating the selective mounting with the wallpaper roll above or within the fluid reservoir illustrating the FIGS. 2 and 3.

More specifically, the wallpaper trough apparatus 10 of the instant invention essentially comprises a trough housing 11, including a first side wall 12 spaced from and parallel a second side wall 13, including respective first and second side wall top end portions 12*a* and 13*a*. For convenience, such as illustrated in the FIG. 5, a handle slot is directed through each side wall adjacent each top end portion. The side walls 12 and 13 are orthogonally mounted to a floor 14, with a front wall 15 defined by a first height mounted to a forward side edge of each side wall, wherein each side wall is defined by a second height greater than the first height to provide for a respective first and second side wall projection portion 23 and 24 that project beyond and above the front wall 15 rotatably mounting an exit guide roll 25 orthogonally between the side walls and above and forwardly of the front wall 15 to define a front wall arcuate guide surface 15*a* positioned below and rearwardly of the exit guide roll 25 to provide for a smooth path of an associated wallpaper roll web 20*a* directed therethrough from an associated wallpaper roll 20, to be discussed in more detail below.

Figure 6:
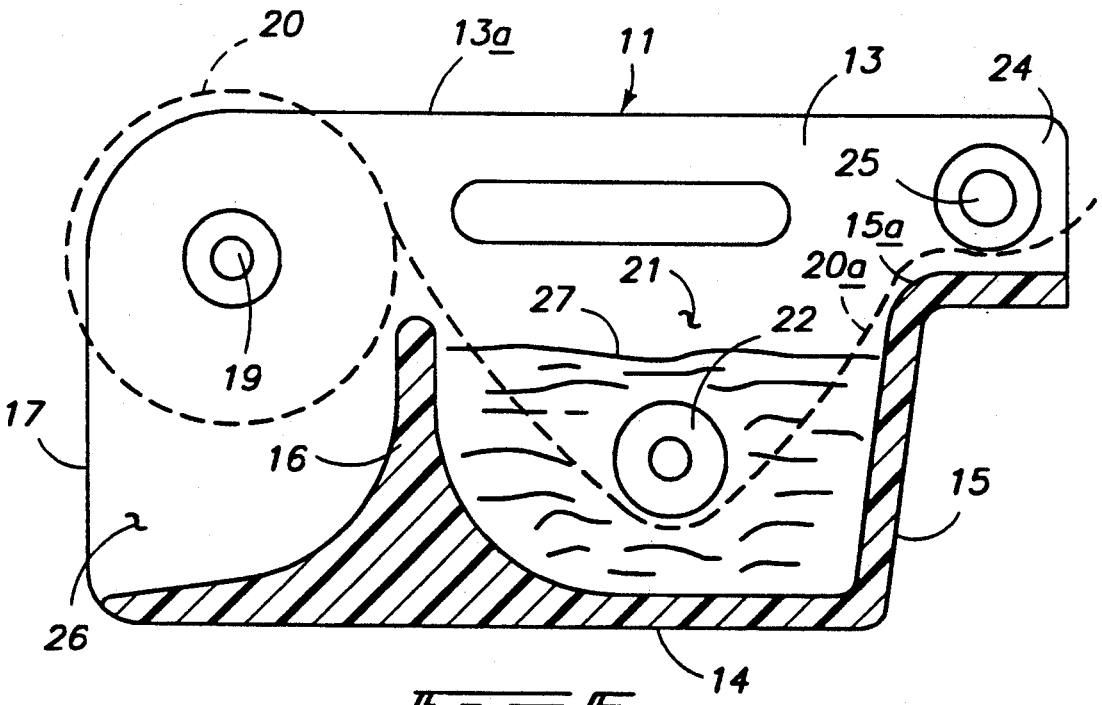
FIG. 6 is an orthographic view, taken along the lines 6—6 of FIG. 4 in the direction indicated by the arrows.

A partition wall 16 is spaced rearwardly of the front wall 15 and forwardly of respective first and second side wall rear edges 18 and 17 of the respective first and second side walls 12 and 13. Thusly, a roll support cavity 26 is defined between the partition wall 16 and the first and second side wall rear side edges 18 and 17. A roll support axle 19 is orthogonally mounted between the side walls spaced above the partition wall 16 and forwardly of the rear side edges 17 and 18 for mounting the wallpaper roll 20 rotatably thereabout. The partition wall 16 and the forward wall 15 define a fluid trough 21 therebetween to accommodate a quantity of fluid, such as water or a paste therewithin, wherein a fluid trough guide roll 22 is mounted within the fluid trough 21 spaced below the roll support axle 19 and the exit guide roll 25, as well as below the partition wall 16, to position the fluid trough guide roll 22 below a top surface of the fluid 27, such as illustrated in FIG. 6. The guide rolls 19, 22, and 25 are arranged in a parallel relationship in use.

Figure 7:
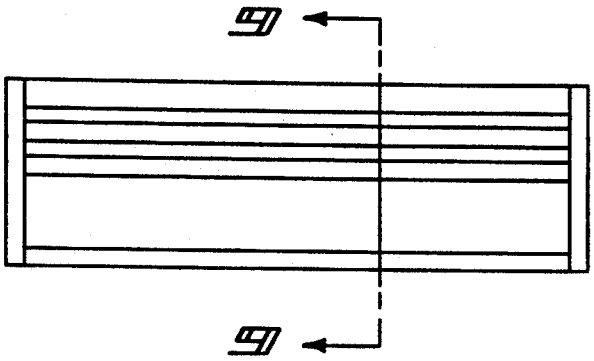
FIG. 7 is an orthographic rear view of a modification of the invention.
Figure 8:
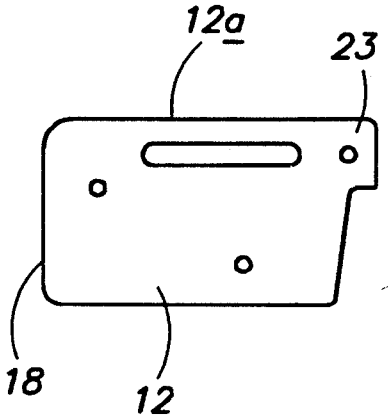
FIG. 8 is an orthographic side view of the modification of the invention.
Figure 9:
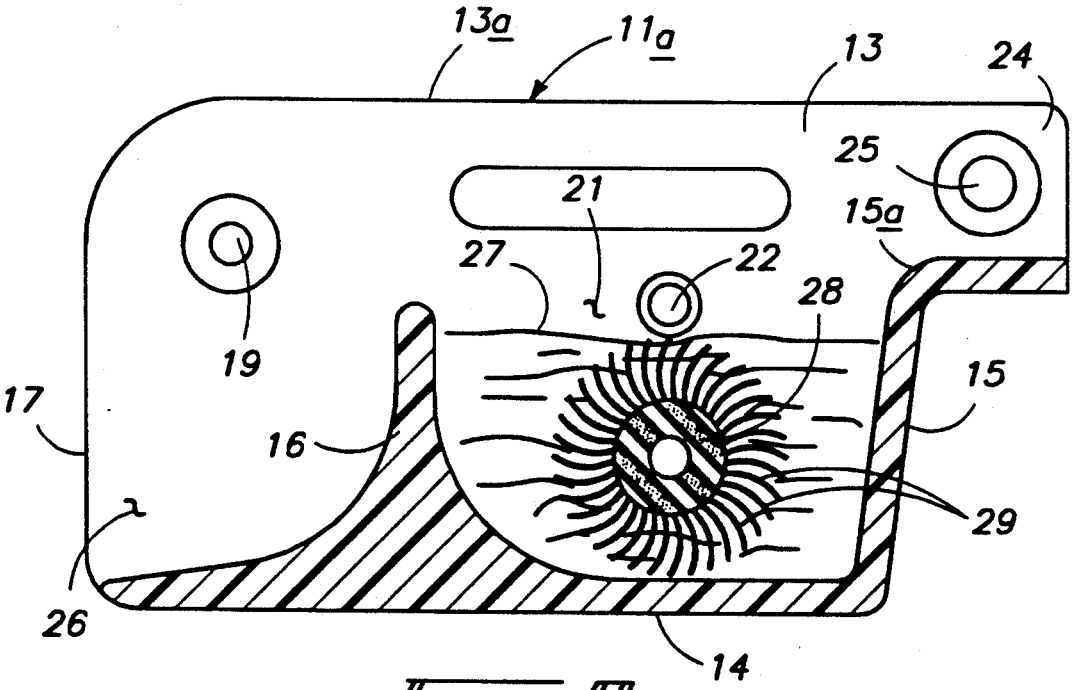
FIG. 9 is an orthographic view, taken along the lines 9—9 of FIG. 7 in the direction indicated by the arrows.

The FIGS. 7-9 illustrate a modified trough housing 11*a*, wherein the fluid trough guide roll 22 is positioned adjacent an upper terminal end portion of the partition wall 16, wherein a fluid absorbent applicator roll 28 is mounted within and below the fluid level 27 that includes a matrix of bristle brush members 29 extending radially outwardly of the applicator roll 28. The bristle brush members 29 are defined by a predetermined length greater than a predetermined spacing between the fluid trough guide roll 22 and the applicator roll 28 to effect deflection of the bristle brush members 29 to thereby enhance imparting of a fluid or glue material upon the web 20*a* as it is directed through the fluid trough 21.

Figure 10:
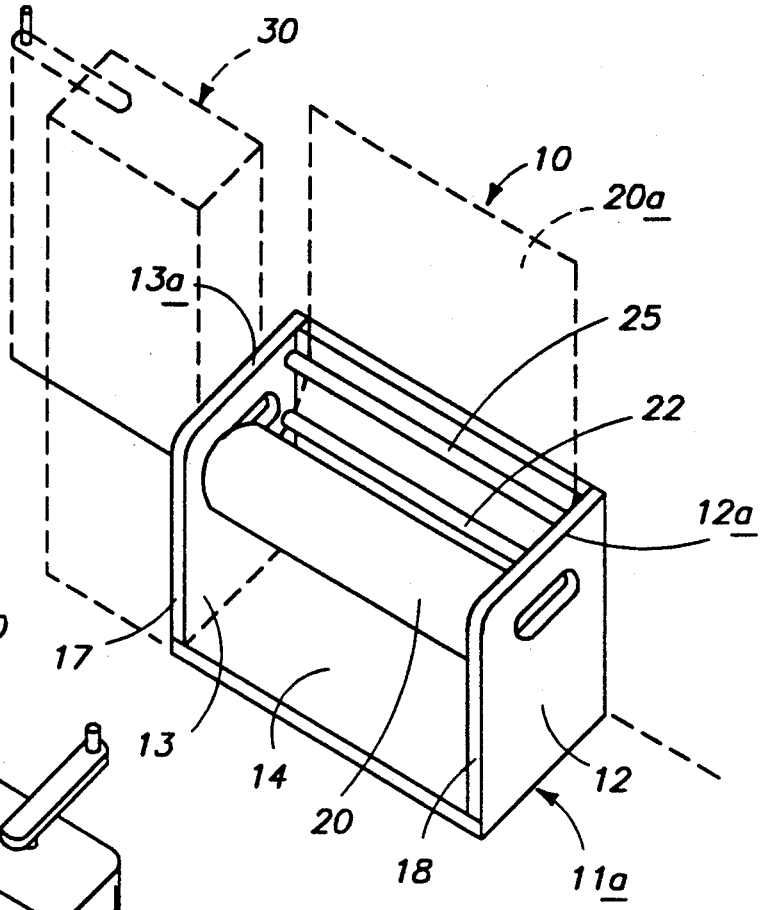
FIG. 10 is an isometric illustration of the modified structure in use.
Figure 11:
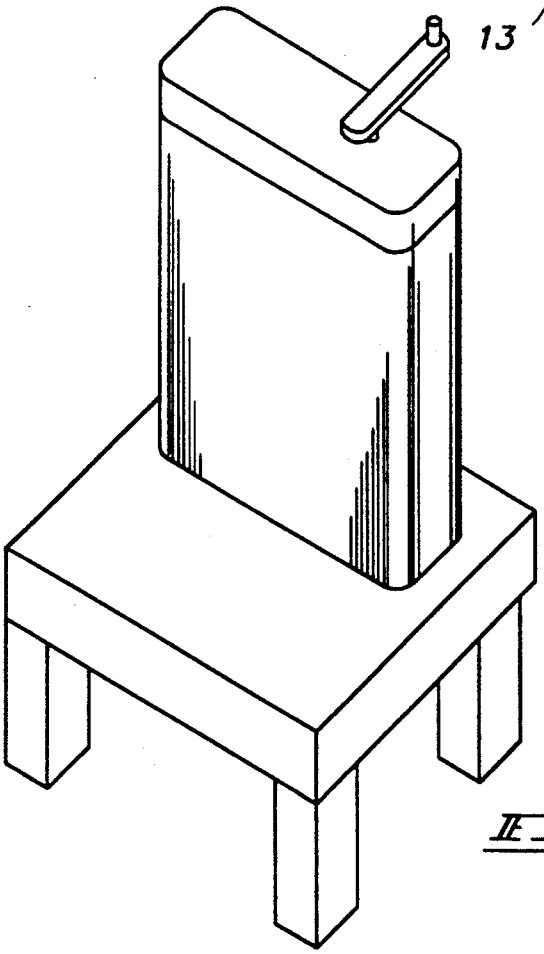
FIG. 11 is an isometric illustration of a supply reservoir utilized by the invention.
Figure 12:
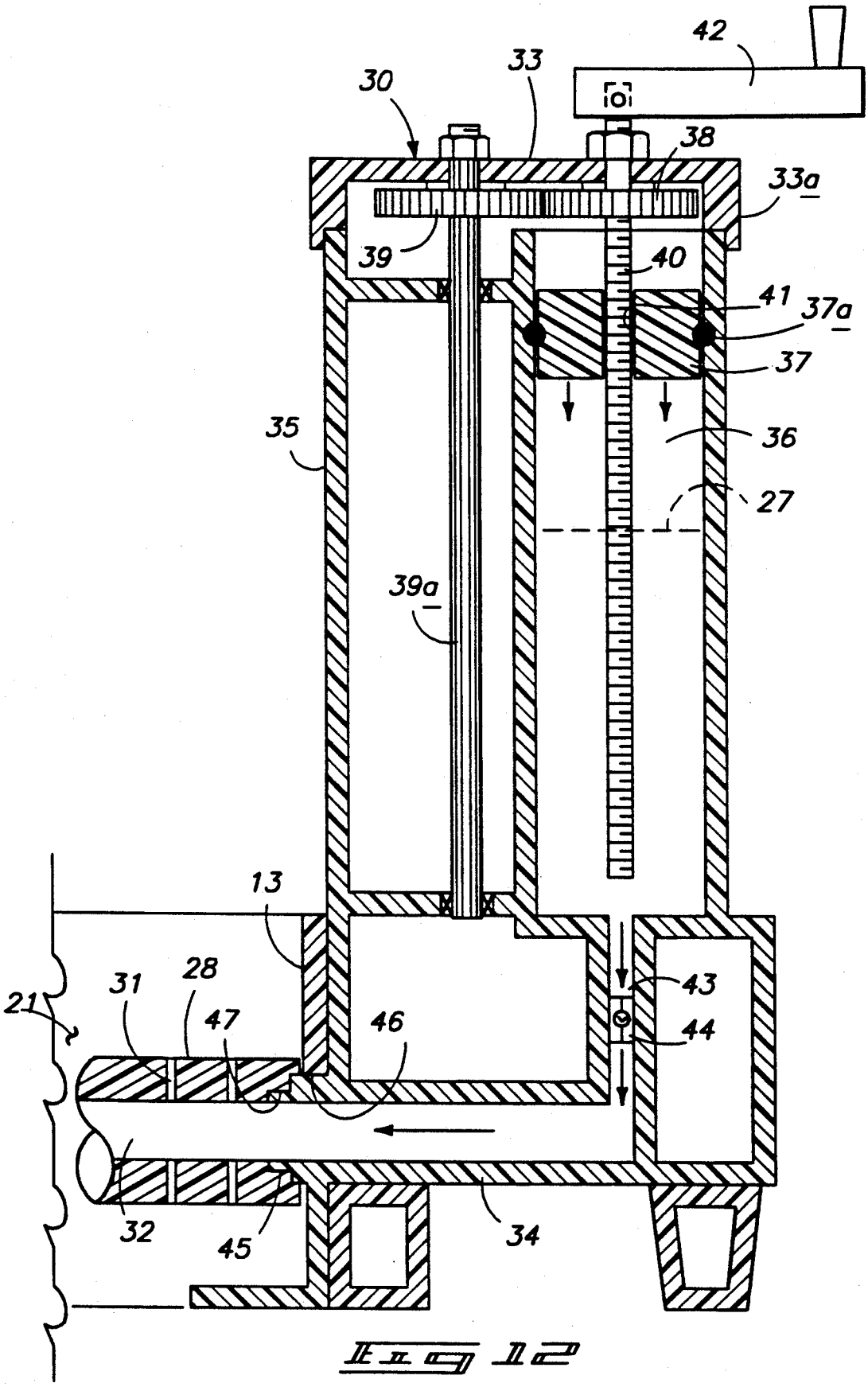
FIG. 12 is an orthographic cross-sectional view of the fluid reservoir in association with the modified trough housing utilized by the invention.

Reference to the FIGS. 10-12 illustrate the use of a supply reservoir 30 mounted in fluid communication with the modified trough housing 11*a*. The supply reservoir 30 includes a direction of a glue material contained therewithin directed into the fluid absorbent applicator roll 28 that is formed with a coaxial bore 32 directed therethrough that is in fluid communication with applicator roll bores 31 that are radially directed through the applicator roll 28 to enhance the imparting of a paste-like material onto the bristle brush members 29, as well as the replenishment of the fluid within the fluid trough 21. The supply reservoir 30 is formed with a side wall 35 and a bottom wall 34 to define a bottom container, wherein a lid 33*a* is securable to the side walls and is formed with a reservoir top wall 33 that rotatably receives a drive gear externally threaded rod 40 orthogonally therethrough. The rod 40 includes a drive gear 38 mounted adjacent an upper terminal end thereof below the top wall 33, wherein an upper terminal end of the rod 40 includes a drive handle 42 to effect rotation of the rod 40. The drive gear 38 cooperates with an idler gear 39 to maintain alignment of the rod 40, wherein a piston 37 including a piston coaxially aligned internally threaded bore 41 cooperates with the externally threaded rod 40 to permit reciprocation of the piston within a cylindrical vertical fluid chamber 36.

The piston is maintained in a non-rotative position by utilizing guide lugs 37*a* mounted diametrically on opposed sides of the piston receivable within cooperating slots to maintain alignment of the piston 37 within the fluid chamber 36. A fluid chamber exit port 43 is mounted in fluid communication with the lower terminal end of the fluid chamber 36 and includes a pressure check valve 44 to direct the fluid through the fluid chamber exit port 43 and through the check valve 44 upon application of a predetermined pressure level effected within the fluid chamber 36 by application of the piston 37 against the fluid 27 within the chamber 36. Side wall 35 of the reservoir 30 includes a resilient nipple 45 projecting exteriorly thereof received within a second side wall receiving bore 46 of the second side wall 13 and rotatably received in a sealing relationship within an applicator roll receiving bore 47 that is coaxially aligned with the coaxial bore 32 of the applicator roll 28. In this manner, selective replenishment of fluid within the fluid trough 21 is provided. Removal of the lid 33*a* permits replenishment of fluid within the chamber 36, as the lid permits removal of the piston 37 and the associated idler gear 39 and its idler gear rod 39*a* that is arranged parallel relative to the externally threaded rod 40.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wallpaper trough apparatus, comprising, a trough housing, wherein the trough housing includes a first side wall spaced from and parallel to a second side wall, the first side wall including a first side wall top end portion, the second side wall including a second side wall top end portion, a floor directed between the first side wall and the second side wall, and the first side wall and the second side wall being fixedly and orthogonally mounted to opposed distal ends of the floor extending upwardly thereof, and the first side wall and second side wall including a respective first side wall forward edge and a second side wall forward edge, and a front wall extending orthogonally between and joining the first side wall forward edge and the second side wall forward edge, wherein the front wall is defined by a first height, and the first side wall and the second side wall are each defined by a second height, wherein the second height is greater than the first height, and the first side wall extends forwardly of the front wall above the front wall, and the second side wall extends forwardly of the front wall above the front wall, and an exit guide roll rotatably mounted orthogonally between the first side wall and second side wall above and forwardly of the front wall adjacent the first side wall top end portion and the second side wall top end portion, and the first side wall including a first side wall rear side edge, and the second side wall including a second side wall rear side edge, and a partition wall fixedly mounted to the floor extending upwardly thereof and coextensively between the first side wall and second side wall between the first wall and the first side wall rear side edge and the second side wall rear side edge to define a roll support cavity between the partition wall and the first side wall rear side edge and the second side wall rear side edge, the partition wall defined by a partition wall height less than the second height, and a roll support axle rotatably mounted coextensively and orthogonally between the first side wall and second side wall within the roll support cavity positioned above the partition wall, and a fluid trough contained between the partition wall and the front wall, and a fluid trough guide roll orthogonally mounted between the first side wall and second side wall rotatably therebetween within the fluid trough, and a fluid absorbent applicator roll arranged parallel to and rotatably below the fluid trough guide roll, the fluid absorbent applicator roll including a matrix of bristle brush members extending outwardly and radially oriented relative to the applicator roll, wherein each bristle brush member of said bristle brush members is defined by a predetermined length, and the fluid trough guide roll is spaced from the applicator roll a predetermined spacing, wherein the predetermined length is greater than the predetermined spacing to effect deflection of each bristle brush member relative to the fluid trough guide roll upon projection of a wallpaper web therebetween, and a supply reservoir mounted to the second side wall, and the applicator roll including a coaxial conduit bore directed coextensively through the applicator roll in fluid communication with the supply reservoir, and the applicator roll including a plurality of applicator roll bores radially directed through the applicator roll in fluid communication with the coaxial conduit bore.

2. An apparatus as set forth in claim 1 wherein the supply reservoir includes a supply reservoir bottom wall and a supply reservoir side wall to define a reservoir container, and the reservoir including a reservoir lid removably mounted relative to the reservoir side wall, wherein the lid includes a lid top wall, the lid top wall arranged parallel relative to the bottom wall, and the reservoir including a cylindrical fluid chamber arranged orthogonally between the top wall and the bottom wall below the lid, wherein the fluid chamber includes a piston, and a threaded rod coaxially directed through the piston and coaxially aligned with the fluid chamber, the piston including an internally threaded bore threadedly cooperative with the threaded rod to effect reciprocation of the piston within the fluid chamber, and an upper terminal end of the threaded rod projects above the top wall, and includes a drive handle orthogonally mounted thereto, a drive gear coaxially mounted to the threaded rod between the top wall and the fluid chamber, and an idler gear positioned adjacent and in cooperation with the guide gear for maintaining alignment of the drive gear and the threaded rod, and the idler gear including an idler gear rod arranged parallel to the threaded rod removably mounted relative to the supply reservoir and mounted to the lid, and a fluid chamber exit port conduit in fluid communication with the fluid chamber, wherein the exit port includes a pressure check valve contained therewithin to direct fluid therethrough upon application of pressure to fluid contained within the fluid chamber, and the fluid chamber exit port being in fluid communication with the coaxial conduit bore of the applicator roll.

3. An apparatus as set forth in claim 2 wherein the side wall of the supply reservoir includes a resilient nipple, and the second side wall of the trough housing including a second side wall receiving bore receiving the nipple therethrough, and the nipple being received within an applicator roll receiving bore rotatably within the coaxial conduit bore to provide a sealing relationship between the nipple and the conduit bore.

* * * * *